United States Patent [19]

Jay et al.

[11] Patent Number: 5,074,620

[45] Date of Patent: Dec. 24, 1991

[54] WHEELCHAIR SEAT SYSTEM

[75] Inventors: Eric C. Jay, Boulder; Michael Nordquist, Louisville, both of Colo.

[73] Assignee: Jay Medical, Ltd., Boulder, Colo.

[21] Appl. No.: 599,145

[22] Filed: Oct. 17, 1990

Related U.S. Application Data

[63] Continuation of Ser. No. 403,105, Sep. 5, 1989, abandoned.

[51] Int. Cl.[5] ..... A47C 3/20

[52] U.S. Cl. ..... 297/337; 297/338; 297/DIG. 4; 297/252

[58] Field of Search ..... 297/252, 337, 338, 345, 297/DIG. 4, 440; 108/1, 96, 144; 248/188.2, 297.3, 396

[56] References Cited

U.S. PATENT DOCUMENTS

| | | | |
|---|---|---|---|
| 3,076,678 | 2/1963 | Griffin | 297/DIG. 4 X |
| 4,629,246 | 12/1986 | Fulton | 297/440 X |
| 4,766,838 | 8/1988 | Johnson | 297/252 X |
| 4,773,709 | 9/1988 | Slinkard | 297/252 X |
| 4,802,708 | 2/1989 | Vos et al. | 297/252 |

FOREIGN PATENT DOCUMENTS

| | | | |
|---|---|---|---|
| 41 | 1/1977 | Japan | 248/297.3 |

*Primary Examiner*—Peter R. Brown

*Attorney, Agent, or Firm*—Cook, Egan, McFarron & Manzo, Ltd.

[57] ABSTRACT

Disclosed is a wheelchair seat system which may be adapted to fit virtually any wheelchair frame and provides a high degree of adjustability in order to fit virtually any user and to achieve various therapeutically significant functions. Specifically, the wheelchair seat system of the present invention provides a seat which may be raised or lowered, pitched forwardly or rearwardly, rolled to one side or the other, and slide forward or backward to accommodate the wheelchair user's needs. Further, the seat system of the present invention provides for ready adjustments, and, at the same time, provides for easy disengagement and set-up of the seat system when it is desired to fold up the wheelchair for transport or storage.

18 Claims, 4 Drawing Sheets

WHEELCHAIR SEAT SYSTEM

This is a continuation of copending application Ser. No. 07/403,105 filed on 9-05-89, now abandoned.

The present invention relates to a seat system for wheelchairs. Specifically, the present invention relates to a wheelchair seat system which may be adjusted to fit virtually any wheelchair frame, may be adjusted to fit virtually any wheelchair user, and further, may be easily adjusted to fit the changing needs of the user. While being easily adjustable, the present invention provides for sound mechanical support of the user. The wheelchair seat system may be used on new wheelchairs and may be retrofitted onto existing wheelchairs.

BACKGROUND OF THE INVENTION

Many of the problems faced by wheelchair users, particularly cerebral palsy, are kyphosis, scoliosis, instability, internal rotation of the legs and even dislocated hips among children. These conditions are aggravated by soft, curved, "sling" upholstery conventionally used in wheelchairs. Previous attempts to alleviate some of these problems included custom made seats which are expensive to make and either do not adjust or are difficult to adjust.

The present invention replaces the conventionally used wheelchair seat sling upholstery with a sturdy, adjustable, supportive, easy-to-use seat system designed to adjust to the user's current and future needs, and provide a range of adjustments in order to attack the above problems.

Kyphosis

Kyphosis, the most common back deformity for wheelchair users, is a rounding of the spine in a "humpback" posture and is often combined with a "slouching" posture, with the hips sliding away from the back of the wheelchair. This condition is most common among older wheelchair patients, but it is rapidly becoming a problem among young paraplegics and quadriplegics sitting against low "sport" backs.

The seat system of the present invention is adjustable so that it can tilt the user back and up against the seat back in order to keep the user in a position with the spine properly aligned.

Scoliosis

Scoliosis, an S-curvature of the spine, is most frequently developed by females. It is often caused by a non-supportive sitting base that encourages pelvic obliquities (uneven hips). The seat system of the present invention is fully adjustable in "roll" to even out the hips and counteract side-to-side leaning and the development of scoliosis.

Instability

The tendency to fall from side-to-side or to fall forward is common among wheelchair users with head injuries, multiple sclerosis, quadriplegics and other disabilities where there is an impairment of cognitive or nerve function. To prevent the tendency to fall, these patients tend to slouch in their wheelchairs in order to lower their center of gravity and gain stability.

The seat system of the present invention may be adjusted to tilt the user back in the chair to push the user up against the seat back and improve the stability.

Some attempts have been made to replace sling wheelchair upholstery with a plywood seat. These plywood seats are custom-cut for each individual wheelchair and for each individual wheelchair user. Furthermore, custom hardware has to be fitted to mount the plywood seat onto the wheelchair frame and to counteract any problem the user may have sitting in the wheelchair. As the wheelchair user's needs change, the plywood seat and the mounting hardware have to be modified accordingly.

The seat system of the present invention is an improvement upon the custom cut plywood seats by fitting virtually all configurations of wheelchair frames, and having mounting hardware which may be easily adjusted to fit the current and future needs of the user.

The Canadian Posture & Seating Company of Kitchner, Ontario, Canada, has marketed a "universal" solid wheel chair seat. However, this wheelchair seat has mounting hardware that is very difficult to adjust.

U.S. Pat. No. 4,629,246 for a WHEELCHAIR SEAT which issued to W. Fulton on Dec. 16, 1986, discloses a solid wheelchair seat which snaps onto and off of a wheelchair's seat rails in order to facilitate collapsing of the wheelchair. This patent discloses slots or cut outs for the wheelchair's pivotally interconnected struts or crossbraces. Also disclosed is a somewhat variable height adjustment means. The wheelchair seat of the Fulton patent is not, under normal circumstances, quickly and easily adjusted to fit the changing comfort and physical needs of the user. The Fulton wheelchair seat also does not disclose a means for keeping the wheelchair seat from slipping off of the wheelchair seat rails, in situations where the user might, for example, frequently get into and out of the wheelchair. The hooks of Fulton would have a tendency to slide on the rails, and, if the hooks were not all adjusted to the same height, would not sit squarely on the wheelchair frame, thus causing instability of the seat.

The seat system of the present invention, as stated above, can be adjusted to fit almost any wheelchair frame and fit the current and changing needs of the user. At the same time, the seat system provides a solid mechanical support for the user. The seat system of the present invention also provides a universal mounting system which will accommodate wheelchairs having seat rails of differing widths, various brake and crossbar configurations. These features allow the seat system of the present invention to be retrofitted onto existing wheelchairs, as well as installed as original equipment on wheelchairs. Moreover, the mounting system which forms a part of the present invention allows ready removal of the seat system in order to collapse the wheelchair for transportation or storage, and provides for easy reinstallation to provide a stable wheelchair seat.

BRIEF DESCRIPTION OF THE PRESENT INVENTION

The present invention provides a wheelchair seat system which may be adapted to fit virtually any wheelchair frame and provides a high degree of adjustability in order to fit virtually any user and to achieve various therapeutically significant functions.

Specifically, the wheelchair seat system of the present invention provides a seat which may be adjusted forward and aft in the frame, in height, in width to provide for varying frame widths, in "pitch" and "roll". At the same time, the wheelchair seat bottom remains solidly engaged in the wheelchair frame, providing a sound mechanical base for the user.

Further, the seat system of the present invention provides for ready adjustments, and, at the same time, provides for easy disengagement of the seat system when it is desired to fold up the wheelchair for transport or storage. When the wheelchair is unfolded after storage, the seat system easily engages the wheelchair frame, and remains in the previously set adjustment. The wheelchair seat system of the present invention may be retrofitted onto existing wheelchairs, as well as fitted as original equipment on new wheelchairs.

DESCRIPTION OF THE DRAWINGS

In order that the invention may be more readily understood, including the various embodiments of the invention, reference is made to the accompanying drawings in which.

DETAILED DESCRIPTION OF THE PRESENT INVENTION

Figure 1:
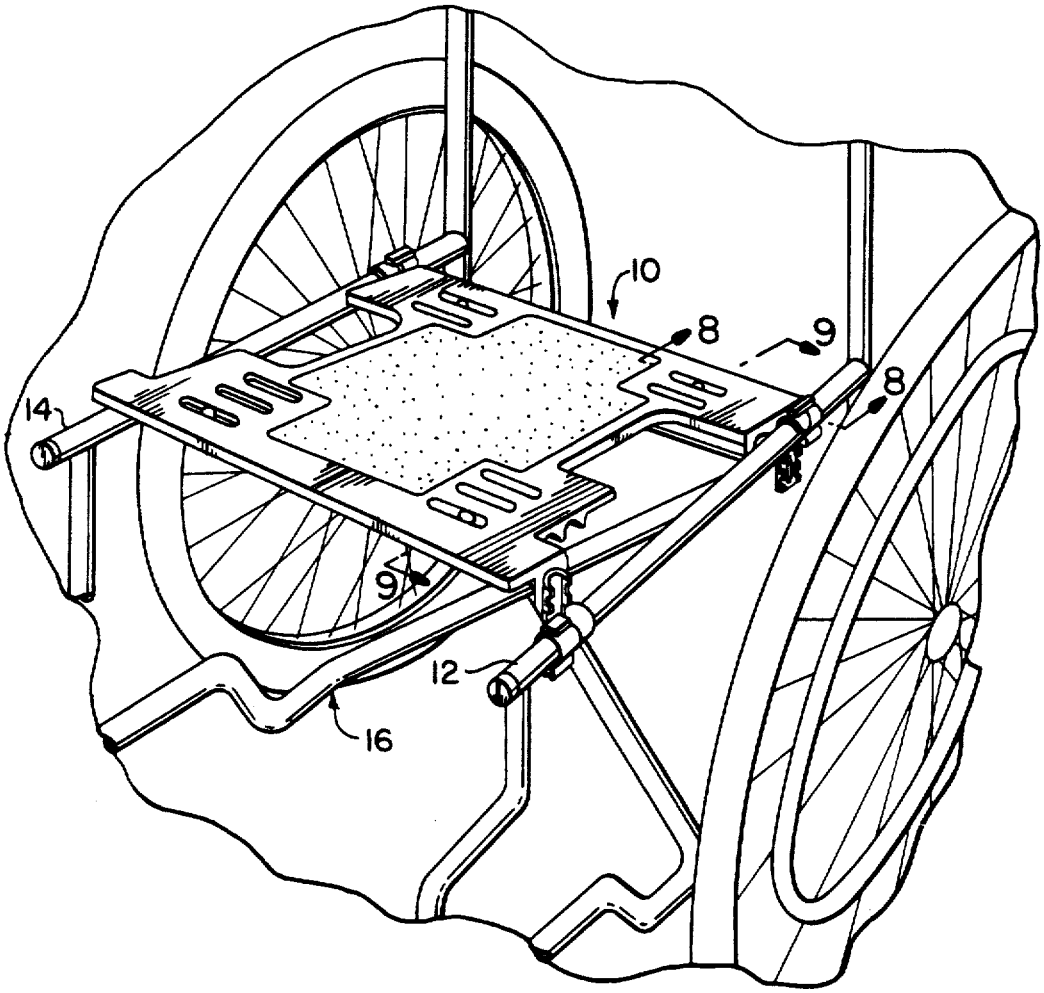
FIG. 1 is a perspective view of the wheelchair seat system of this invention with portions of the wheelchair deleted for clarity.

The wheelchair seat system of the present invention, shown in FIG. 1, generally comprises a rigid seat bottom 10 and a mounting system which is used to affix the rigid seat bottom to a wheelchair frame, shown generally at 16. The mounting system affixes the rigid seat bottom 10 to varying widths of horizontal seat rails 12 and 14, and provides for adjustment in the forward/aft position, adjustment in height, adjustment in pitch and adjustment in roll of the seat bottom with respect to the wheelchair frame 16, as will be described hereinafter, below.

The wheelchair seat system of the present invention is also adapted to receive a wheelchair seat cushion system, such as the seat cushions manufactured by Jay Medical, Limited of Boulder, Colo., U.S.A., and patented under U.S. Pat. Nos. 4,588,229 and 4,726,624.

Seat Bottom

The seat bottom generally shown at 10 is a hard, relatively rigid, relatively inflexible matrix which extends substantially horizontally between seat rails 12 and 14 of a wheelchair frame 16. The wheelchair seat bottom 10 of this preferred embodiment is molded of urethane plastic; however, other materials (i.e., fiberglass, ABS, structural foams, etc.) may be used without departing from the spirit of this invention (i.e., fiberglass).

Figure 2:
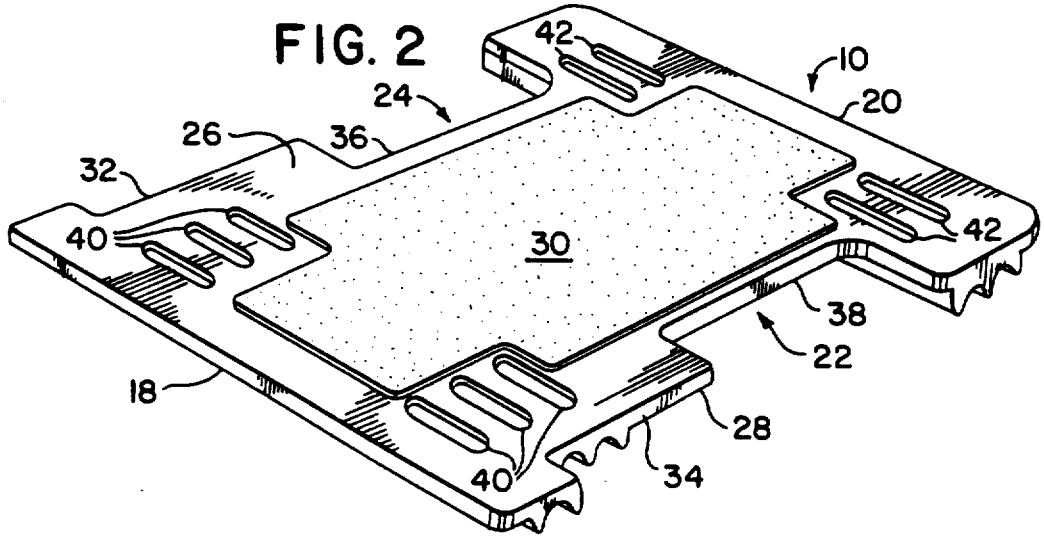
FIG. 2 is a perspective view of the wheelchair seat bottom.

As can best be seen in FIG. 2, the seat bottom 10 of this preferred embodiment has a front side 18, a rear side 20, a left side 22, a right side 24, a top 26 and a bottom 28. All of the edges and corners of this preferred embodiment are rounded. On the top side 26 of the seat bottom 10 of this preferred embodiment is an anti-skid pad 30. The anti-skid pad 30 is preferably made from a resilient non-absorbent material, such as hard rubber. The anti-skid pad helps to prevent a seat cushion (not shown) which may be used from sliding on the seat bottom 10.

As best seen in FIG. 2, the seat bottom 10 is substantially "H" shaped and approximately 13 inches in width and 17 inches in length, with two sets of cut-outs. The first set of cut-outs 32 and 34 are approximately 2 inches rearward of the front edge 18 of the seat bottom 10 and are stepped in ⅜ of an inch on each side, in the preferred embodiment. The second set of stepped cut-outs 36 and 38 are approximately 6½ inches rearward of the front edge 18 of the rigid seat and are approximately 2 inches in depth inwardly from the first set of cut-outs 32 and 34. The second set of cut-outs 36 and 38 end approximate 4 inches in front of the rear edge 20. These two sets of cutouts allow for various configurations of wheelchair cross bars, brake levers and the like. For variations in size and shape of wheelchair frames, the cutouts would have to be adjusted as would be within the capability of one skilled in the art.

A plurality of slots are provided in the front 40 and rear 42 of the solid seat bottom 10 to provide for the attachment and adjustment of the mounting system hardware. In the preferred embodiment of this invention, the slot is counterbored on top 26 to allow for a mounting bolt head to sit below the surface of the seat. Optionally, the slots 40 and 42 may be calibrated to indicate the width that the mounting hardware is adjusted to for ease of installation.

Figure 3:
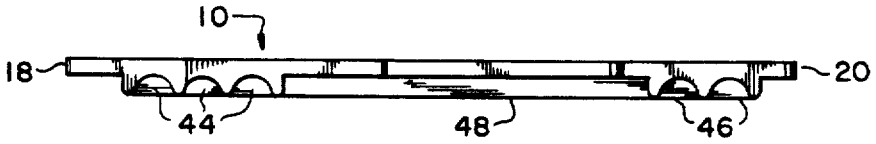
FIG. 3 is a side view of the wheelchair seat bottom of this invention.

Turning now to FIG. 3, a side view of the left side 22 of the seat bottom 10 is shown. Three front channels 44 are two rear channels 46 are provided for the mounting hardware system in this preferred embodiment. As illustrated, each channel in the preferred embodiment is semicircular in section, which permits the mounting hardware to be variously adjusted, as will be described hereinafter below. A plurality of channels is provided in both the front 18 and the rear 20 in this embodiment so that the solid seat bottom may be adapted for use in a variety of positions on a wheelchair, and to adjust to fit a plurality of wheelchair frames. Also illustrated in FIG. 3 are gussets 48, as are known in the art to add structural reinforcement and support to the seat bottom 10.

Figure 4:
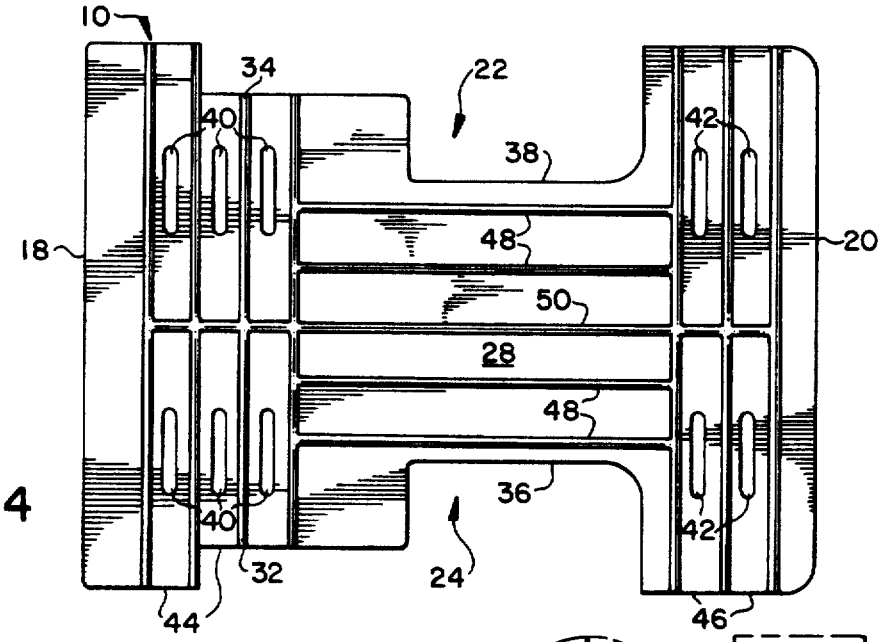
FIG. 4 is a bottom view of the wheelchair seat bottom of this invention.

Turning now to FIG. 4, a bottom view of the preferred embodiment of the seat bottom 10 of this invention is shown. There is shown a plurality of gussets 48 extending from the front 18 to the rear 20 on the bottom 28 of the seat bottom 10. In the preferred embodiment, these gussets are approximately ¾ inches deep. The gussets 48 add antibowing properties to the middle of the slat. Center gusset 50 extends from the front of the first channel 44 in the front 18 of the solid seat 10 to the rear of the back channel 46 in the rear 20 of the solid seat 10. This view also clearly illustrates the two pairs of stepped cut-outs in the solid seat bottom 10, and the plurality of channels for attachment of the mounting system of the this preferred embodiment. The channels are approximately 1 inch deep in the preferred embodiment, and also act as gussets or reinforcement in the lateral direction.

Mounting System

Figure 5:
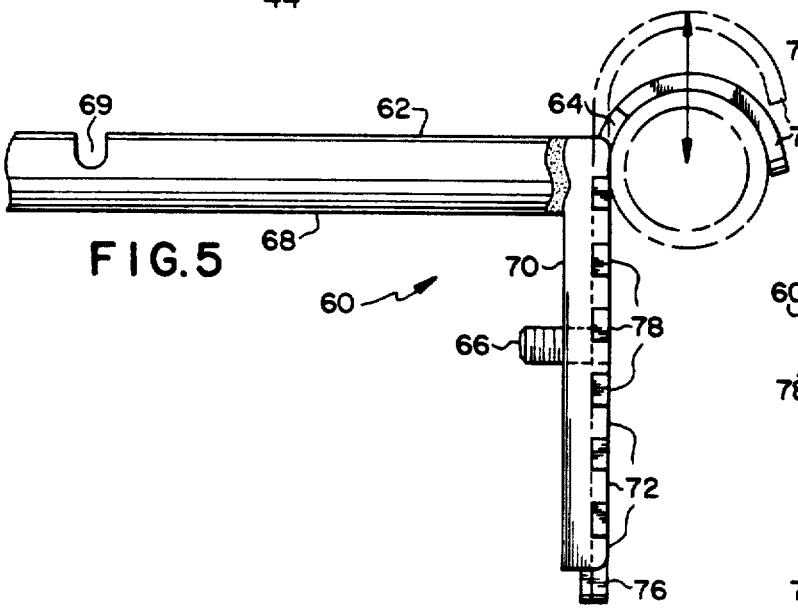
FIG. 5 is a side view of an example of the mounting hardware with the height adjustment in phantom view.

The mounting system of the preferred embodiment of this invention includes four hardware mounting brackets 60, an example of which is shown in profile in FIG. 5. The mounting brackets 60 of the preferred embodiment may be steel, or may also be high-strength plastic, such as polycarbonate. Each mounting bracket 60 in the preferred embodiment includes three pieces: an L-shaped bracket 62, a J-shaped member 64 and a screw 66. The L-shaped bracket 62 comprises a horizontally arched channel 68 which is removably mountable to the channels of the solid seat bottom and arched to the same radius as the channels 44 and 46, so that the arched channel 68 is compatible with the channels 44 and 46. A transverse slot 69 is cut in the L-shaped member approximately ¾ inch from an end opposite the vertical channel 70. The slot 69 provides for adjustably affixing the mounting bracket 60 to the seat bottom 10, as will be more fully described below. In the preferred embodiment, the arched channel 68 is welded or braised to a vertical height adjustment channel 70.

Figure 6:
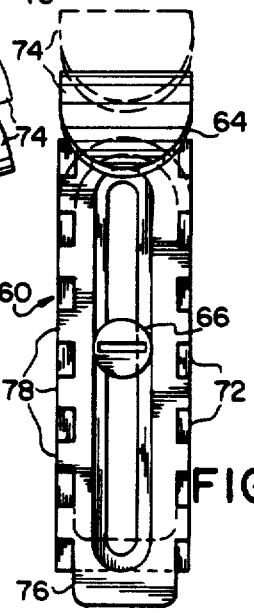
FIG. 6 is a plane view of an example of the mounting hardware of this invention with the height adjustment shown in phantom.
Figure 7:
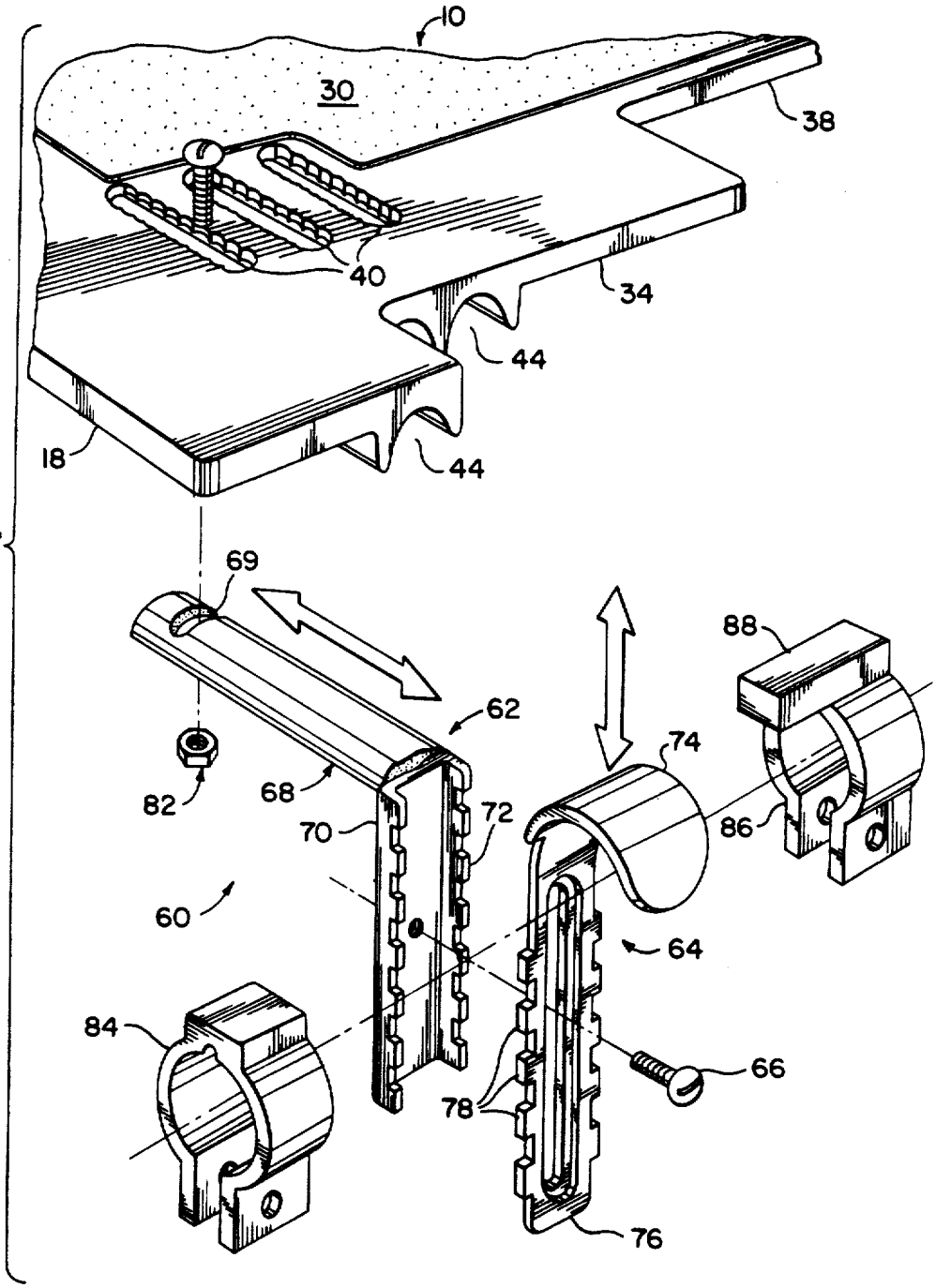
FIG. 7 is a fragmentary exploded perspective of the wheelchair seat bottom and the mounting hardware.

As seen in FIGS. 5, 6 and 7, the vertical height adjustment channel 70 of this embodiment is a squared channel, with a plurality of square teeth 72 cut into both sides of the channel. The vertical member 70 also has a threaded hole for threadingly engaging the screw 66, which mounts the J-shaped member 64 to the vertical member 70.

The J-shaped member 64 comprises a hook 74 for resiliently engaging a wheelchair seat rail 12 and 14 and a shaft 76. The shaft 76 of the J-shaped member 64 in the preferred embodiment includes a plurality of square teeth 78 configured to interlockingly engage the teeth 72 of the vertical member 70. The interlocking of the teeth 72 with the teeth 78 enables the mounting system of this invention to be easily adjustable with only one bolt at each location, yet possess sufficient mechanical strength to support the full weight of a user. The hook 74 of the J-shaped member 64 is preferably steel which will snap easily onto or off of the wheelchair seat rails. There is a slot in the shaft of the J-shaped member which is counter-bored for receiving the mounting screw in this preferred embodiment.

Adjusting The Seat System To Fit A Wheelchair

To use the seat system of this invention, the first step is to remove the existing upholstery from the wheelchair frame. Turning to FIG. 7, four mounting brackets 60 are assembled together by placing a J-shaped member 64 in engagement with an L-shaped bracket 62, so that the teeth on the respective pieces mesh. A screw 66 is then inserted and tightened. A mounting bracket 60 is placed in each corner in the respective channel of the seat bottom 10 closest to the edge, two in the front 18 and two in the rear 20. A mounting screw 80 is threaded through the top of the seat bottom 10 in the transverse slot 69 provided, and a nut 82 is threaded onto the mounting screw 80. The width of the brackets 60 of the solid seat system can then be adjusted to fit the width of the seat rails of the wheelchair frame by loosening the mounting bolts and narrowing or widening the width between the hooks 74 accordingly. When the proper width has been determined, the mounting bolts are then tightened. The hooks 74 may then be snapped over the seat rails of the wheelchair frame 12 and 14.

In the preferred embodiment, if the wheelchair frame is 15 inches in width between the seat rails, it may be necessary to narrow the seat bottom 10. The seat bottom 10 may be cut, for example, with a band saw up to approximately 1.5 inches without affecting the integrity of the support.

Adjusting the Solid Seat System To Fit The User

The length of the seat bottom 10 may be adjusted by sliding the seat bottom 10 forwardly on the wheelchair frame or backwardly between the posts of the wheelchair frame. In this way, the seat length may be adjusted to the needs of the user by approximately 2 inches (from approximately 18 inches to approximately 16 inches). If a user requires a seat length less than 16 inches, the solid seat bottom 10 may be cut in the front and/or rear by means of a band saw, up to approximately 6 inches. The seat bottom 10 can then be checked for fit on the wheelchair frame and compared to the fittings and options of the wheelchair. If the seat bottom 10 or any mounting hardware 60 interferes with the operation of the wheelchair or if the front or rear mounting brackets 60 are 1 inch or less from the end of the seat rail of the wheelchair frame, the mounting brackets 60 may be removed and reinstalled in a non-interfering, alternate channel.

The seat bottom 10 can then be adjusted for height, by loosening the screw 66 in the slot of the J-shaped member 64 until the teeth 72 of the J-shaped member 64 and the teeth 74 of the L-shaped bracket 62 disengage. The height of the seat can then be adjusted relative to the frame in one-half inch increments, in the preferred embodiment, from approximately one inch above the chair rail to approximately 1½ inches below the seat rail (for a total of 2½ inches of adjustment). When the desired seat height is set, the mounting screw 66 is tightened. A hook stopper 84 and a hook retainer 88 may then be installed. Also, a seat cushion, if used, may be installed at this time.

A hook stopper 84 may be attached to the wheelchair seat rail 12 in front of the hook 74 of the J-shaped member 64 of the mounting bracket 60. The hook stopper 84 prevents the mounting bracket 60 from sliding forwardly and ultimately off of the wheelchair frame and prevents the seat system from moving out of position. The hook stopper 84, however, does not prevent the mounting bracket 60 from being vertically disengaged from the seat rail 12. Therefore, the seat bottom 10 may be snapped out so that the wheelchair may be collapsed for transportation or storage.

A hook retainer 86 may be slid onto the back of the seat rail behind the seat system. The hook retainer 86 has a retaining member 88 which can be placed over top of a hook 74 of the mounting bracket 60 on each seat rail 12 and 14. The hook retainer 66 prevents the hook 74 from sliding backwards or from accidentally disengaging from the wheelchair seat rail. Both the hook stopper 84 and the hook retainer 88 are mounted on the wheelchair seat rail by way of a nut and bolt (not shown). For wheelchairs that are often collapsed for storage or transportation, two hook stoppers 84 may be placed on one wheelchair seat rail.

Adjustment of the Seat System To Fit The Current And Future Needs Of The User The seat system of this invention may be adjusted quickly and easily along at least five planes. Regardless of the angle of adjustment, the hooks 74 of the mounting brackets 60 remain engaged squarely on the seat rails 12 and 14, so as to provide a solid base of support for the wheelchair user, while permitting adjustment for the comfort and convenience of the user.

Accordingly, the seat system of this invention may be adjusted forward and back along a longitudinal plane extending from the front 18 to the rear 20 of the seat bottom to adjust to the length of the wheelchair frame and the user's needs. The seat system may be adjusted in width along a second horizontal plane extending from the left side to the right side of the solid seat and perpendicular to the first plane. The seat system may be adjusted in height along a plane extending perpendicularly from both the first and second planes, above.

The seat system of this embodiment of the invention may also be adjusted in two planes which are especially useful in correcting certain conditions of long-term wheelchair users. The seat system of this invention may be adjusted around an axis coextensive with the longitudinal plane, hereinafter called "roll". The solid seat of this invention may also be adjusted around a transverse axis hereinafter called "pitch".

Figure 8:
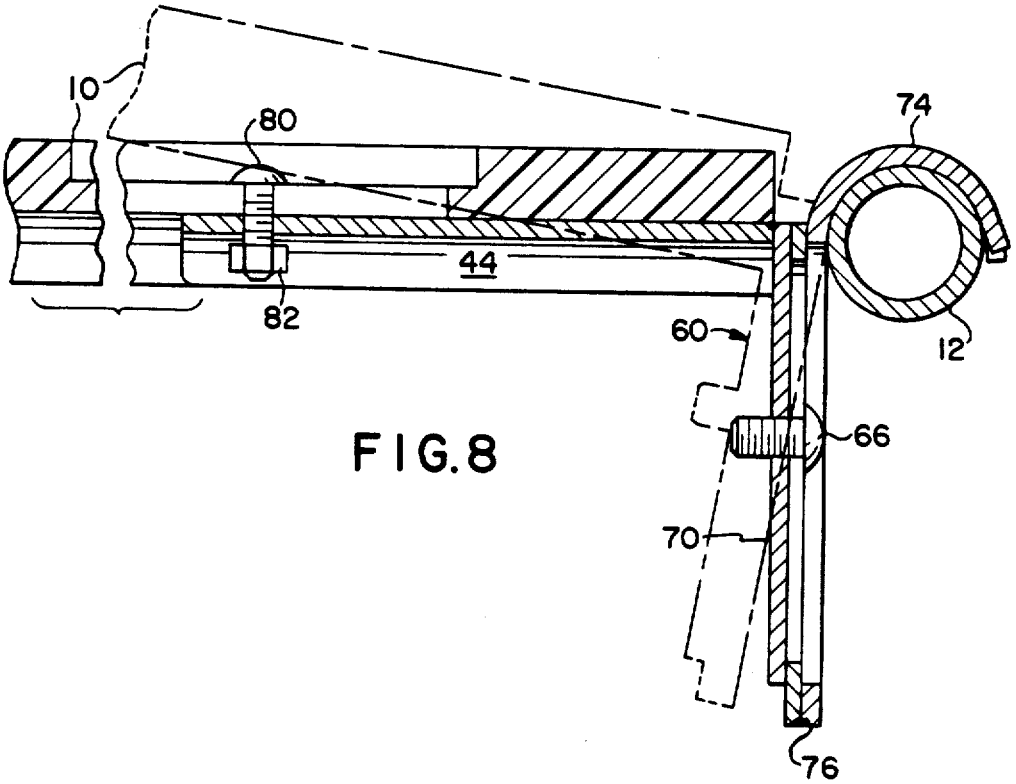
FIG. 8 is a fragmentary cross-sectional side view of the wheelchair seat system of this invention showing possible adjustables in phantom taken along line 8—8 of FIG. 1.

Turning now to FIG. 8, the various adjustments of the seat system are shown. FIG. 8 shows a cutaway view of the seat bottom and mounting system taken along line 8—8 of FIG. 1. The solid lines of FIG. 8 illustrate the mounting system set up so that the seat bottom 10 is horizontal in respect to the wheelchair frame 16. The seat bottom 10 is nominally higher than the chair rail 12.

The phantom lines of FIG. 8 illustrate an adjustment in roll of the seat mounting system, with the left side 22 of the seat bottom 10 higher than the right side 24. This would be the case when, for example, a patient requires having one hip higher than the other. Note that hook 74 of the J-shaped member 64 remains fully engaged with the chair rail 12, thus permitting the adjustments while fully supporting the user.

Figure 9:
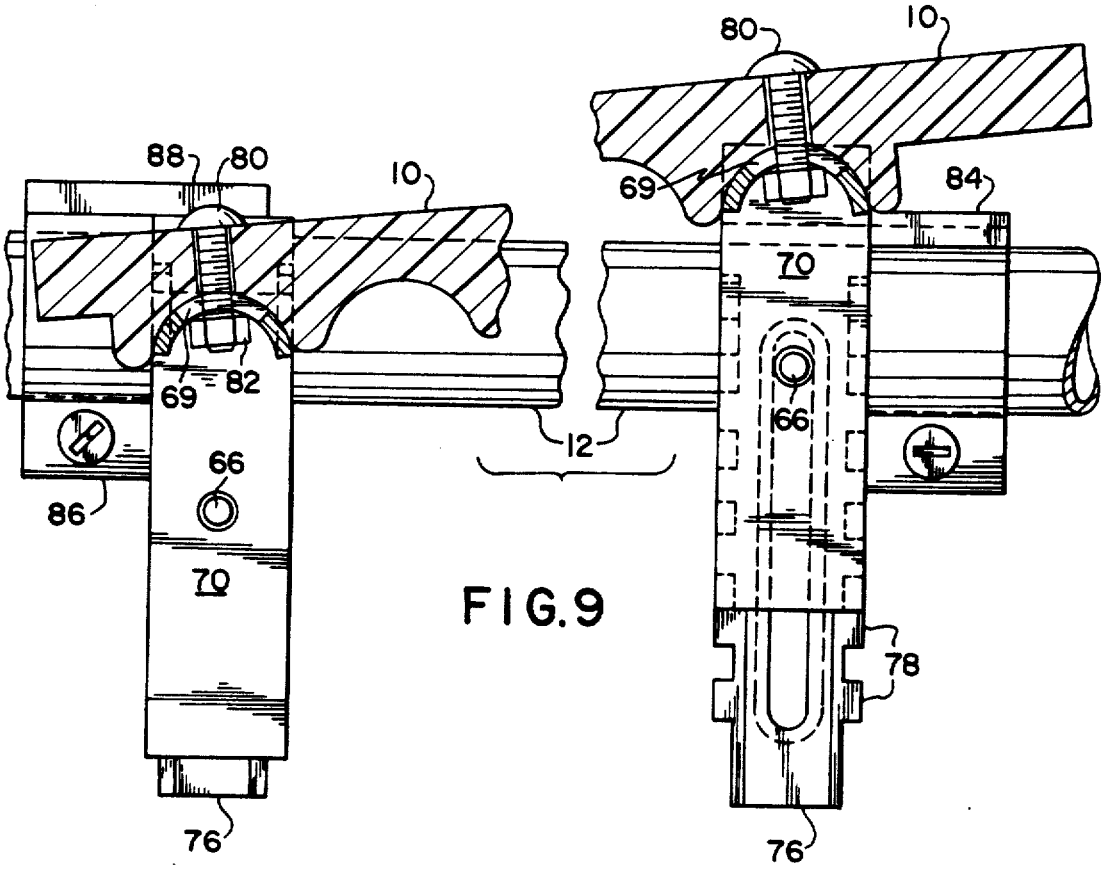
FIG. 9 is a fragmentary cross-sectional side view of the wheelchair seat system taken along line 9—9 of FIG. 1.

FIG. 9 is a cross-sectional view of the slat system taken along linen 9 of FIG. 1, showing an adjustment in the pitch of the solid seat. FIG. 9 shows the rear 20 of the seat bottom 10 adjusted higher than the front 18. In phantom lines, the forward L-shaped bracket 62 is adjusted lower than the rear L-shaped bracket 62. The hooks 74 of the J-shaped members 64 remain fully engaged with the chair rail 12 in this position. The interaction of the channels 44, 46 of the solid seat bottom 10 and the arched channel members 68 of the mounting bracket 60 permits the seat bottom to be pitched rotationally toward the front 18 while the mounting bracket 60 remains vertically aligned on the chair rail 12, and thus the hook 74 of the J-shaped member 64 remains fully engaged on the chair rail 12. The slot 69 on the arched channel 68 permits the mounting screw to be installed at a rotationally pitched angle. FIG. 9 also shows the hook stopper 84 and hook retainer 86 installed on the forward and rear hooks 74, respectively.

The scope of the invention herein shown and described is to be considered only as illustrative. It will be apparent to those skilled in the art that numerous modifications may be made herein without departure from the spirit of the invention and scope of the appended claims.

I claim:

1. A wheelchair seat system including means for removably mounting said system on spaced-apart seat rails of a wheelchair frame, said system comprising:

a seat bottom and seat mounting means;

said seat bottom being substantially rigid and having a top side and a bottom side, said seat bottom having at least one transverse channel on said bottom side;

said seat mounting means including at least four independently adjustable mounting brackets, said mounting brackets including rail engaging means for engaging said seat rails and vertical adjustment means to facilitate vertical adjustment of said seat bottom;

said mounting brackets including an arm adapted to engage said transverse channel, said arm being rotatably secured in said transverse channel to allow said rail engaging means to sit flat on said seat rails, irrespective of the angle of said seat bottoms.

2. The wheelchair seat system as described in claim 1 wherein said seat bottom includes a plurality of transverse channels.

3. The wheelchair seat system as described in claim 1 wherein said seat bottom is made of plastic.

4. The wheelchair seat system of claim 1 wherein said bottom side includes at least 3 channels.

5. The wheelchair seat system of claim 1 wherein said vertical adjustment means is an L-shaped piece having a second arm and said rail engaging means is a J-shaped piece for slidable engagement with a wheelchair frame, said second arm of said L-shaped piece and said J-shaped piece being configured for adjustable engagement with each other.

6. The wheelchair seat system of claim 5 wherein said second arm of said L-shaped piece includes a first plurality of teeth and said J-shaped piece includes a second plurality of teeth, wherein said first plurality of teeth and said second plurality of teeth are meshingly engagable so that the first and second plurality of teeth lockingly join said second arm of said L-shaped piece and said J-shaped piece to provide high mechanical integrity and adjustability.

7. The wheelchair seat system of claim 1 wherein said seat bottom has a top side, and an anti-slip pad being affixed to said top side of said seat bottom.

8. A wheelchair seat system including means for removably mounting said system on spaced-apart seat rails of a wheelchair frame, said seat system comprising:

a seat bottom and a seat mounting means; said seat bottom being a molded, one-piece structure, said seat bottom having a top side and a bottom side;

said seat bottom including a plurality of transverse channels on said bottom side of said seat bottom, said transverse channels being configured for receivably and adjustably engaging said mounting means;

said seat mounting means including four mounting brackets, each of said mounting brackets including an L-shaped piece and a J-shaped piece, said J-shaped piece configured to engage a seat rail, said L-shaped piece including a first arm and a second arm, said first arm configured to adjustably engage a transverse channel on said bottom of said seat bottom and to rotate about the axis of said transverse channel to allow said J-shaped piece to sit flat on said seat rails irrespective of the angle of said seat bottom; and a plurality of first teeth on said second arm of said L-shaped member and a plurality of second teeth on said J-shaped member, said first and second teeth adjustably meshingly engaging each other so that said mounting bracket may be adjusted independently while said J-shaped member remains supportively engaged with said wheelchair frame.

9. The wheelchair seat system as described in claim 8 wherein said seat bottom is plastic.

10. A wheelchair seat system including means for removably mounting said system on spaced apart seat rails of a wheelchair frame, said system comprising:

a seat bottom and a seat mounting means;

said seat bottom being substantially rigid and having a top side and a bottom side;

said seat mounting means including at least four independently adjustable mounting brackets, said mounting brackets including a first member adjustably affixed to the bottom side of said seat bottom, said first member having an vertically extended arm;

said brackets including a second member having means to engage a seat rail of said wheelchair frame, and to sit flat on said seat rail irrespective of the angle of said seat bottom, said second member having a vertically disposed arm extending parallel and adjacent to said arm of said first member;

said arms having complementary detects adapted to interlock with one another at discrete vertical positions and to positively engage said detents with respect to one another; and a threaded member adapted to maintain said detents of said arms in an engaged position.

11. The wheelchair seat system as described in claim 10, wherein said threaded member is a screw.

12. The wheelchair seat system as described in claim 10 wherein one of said arms includes a longitudinal slot adapted to slidingly engage said threaded member and the other of said arms includes a threaded hole for threadedly engaging said threaded member.

13. The wheelchair seat system as described in claim 12 wherein said threaded member comprises a head and a threaded shank, and said head is accessible from outside said seat system.

14. The wheelchair seat system as described in claim 10, wherein the detects of said arms comprise a plurality of square teeth adapted to engage said arms positively to each other at descrete vertical positions.

15. A wheelchair seat system including means for removably mounting said systems on spaced-apart seat rails of a wheelchair frame, said system comprising:

a seat bottom and a seat mounting means;

said seat bottom being substantially rigid and having a top side and a bottom side;

said seat mounting means including at least four independently-adjustable mounting brackets mounted on the bottom side of said seat bottom, said mounting brackets including seat rail engaging means for engaging said seat rails and vertical adjustment means to facilitate vertical adjustment of said seat bottom in a wheelchair frame;

said brackets including width adjustment means to provide width adjustment to accommodate seat rails having different spacing, said width adjustment means comprising a threaded member which extends from the top side of said seat bottom through said seat bottom to engage said bracket.

16. The wheelchair seat system as described in claim 15 wherein said seat bottom includes a transverse slot, said width adjustment means includes a threaded member extending through said slot, said threaded member having a head and a threaded shank, said head being accessible from the top side of said seat bottom and said threaded shank extending through said seat bottom to engage said bracket.

17. The seat system as described in claim 16, wherein said width adjustment is accomplished by moving said threaded member transversely in said transverse slot.

18. The seat system as described in claim 17, wherein said transverse slot includes a plurality of detents adapted to receive head and lock said threaded member in a plurality of finite positions corresponding to the position of detents.

* * * * *